US006745421B2

(12) United States Patent
Barrett et al.

(10) Patent No.: US 6,745,421 B2
(45) Date of Patent: Jun. 8, 2004

(54) ABUTMENT WITH SEISMIC RESTRAINTS

(76) Inventors: Robert K. Barrett, 549 S. Broadway, Grand Junction, CO (US) 81503; Albert C. Ruckman, 11488 Nucla St., Commerce City, CO (US) 80022

( * ) Notice: Subject to any disclaimer, the term of this patent is extended or adjusted under 35 U.S.C. 154(b) by 99 days.

(21) Appl. No.: 10/043,693

(22) Filed: Jan. 10, 2002

(65) Prior Publication Data

US 2003/0126695 A1 Jul. 10, 2003

(51) Int. Cl.[7] ..... E01D 19/02
(52) U.S. Cl. ..... 14/26; 52/250
(58) Field of Search ..... 14/26, 77.1; 52/250, 52/275, 281; 405/125

(56) References Cited

U.S. PATENT DOCUMENTS

| | | | | | |
|---|---|---|---|---|---|
| 571,225 | A | * | 11/1896 | Geisel | 52/87 |
| 3,808,624 | A | * | 5/1974 | Barkdull, Jr. | 14/77.1 |
| 3,981,038 | A | * | 9/1976 | Vidal | 14/26 |
| 4,181,995 | A | * | 1/1980 | Zur | 14/77.1 |
| 4,564,313 | A | * | 1/1986 | Niswander et al. | 405/125 |
| 4,564,967 | A | * | 1/1986 | Vidal | 14/75 |
| 4,993,872 | A | * | 2/1991 | Lockwood | 405/125 |
| 5,044,831 | A | | 9/1991 | Myles et al. | 405/259 |
| 5,549,418 | A | * | 8/1996 | Devine et al. | 405/258.1 |
| 5,713,162 | A | * | 2/1998 | Gallo et al. | 52/167.1 |
| 6,533,498 | B1 | * | 3/2003 | Quin | 405/125 |

FOREIGN PATENT DOCUMENTS

EP 0 307 291 * 11/1989

OTHER PUBLICATIONS

Colorado Department of Transportation Bridge Design Manual Section Seven, Substructures (Sections 7.1–7.; 3): Nov. 2, 1987.

Missouri Department of Transportation Bridge Design Manual Section 3.76 Concrete Pile Cap Non–Integral End Bents (Sections 3.76,1–4); Mar. 2000.

* cited by examiner

*Primary Examiner*—Gary S Hartmann
(74) *Attorney, Agent, or Firm*—Sheridan Ross P.C.

(57) ABSTRACT

An abutment especially adapted for use with a bridge is provided which incorporates lateral containment elements which prevent undesirable lateral shifting or movement of the bridge during a seismic event. The lateral containment elements are constructed of varying materials, and form an integral part of the bridge abutment. The lateral containment elements are positioned laterally of the bridge sill and in abutting relationship with the lateral ends of the sill. The lateral containment elements may include mechanically stabilized earth, concrete blocks, concrete blocks with micro-pile tie downs, reinforced concrete blocks with shear keys which extend below ground, or steel piles or beams which are secured in the ground.

21 Claims, 8 Drawing Sheets

ABUTMENT WITH SEISMIC RESTRAINTS

FIELD OF THE INVENTION

This invention relates to an abutment with seismic restraints, and more particularly, to an abutment especially adapted for use with a bridge superstructure, the abutment including integral lateral containment elements which prevent undesirable differential lateral shifting or movement of the bridge superstructure during a seismic event.

BACKGROUND OF THE INVENTION

Engineers throughout history have developed bridge designs which have resulted in literally thousands of different types of bridge constructions. Prime considerations in bridge building are to span a gap in the most safe, efficient, and cost effective manner. While many bridges may be aesthetically pleasing and functional considerations have not been the driving factor for their design, a great majority of bridges are designed primarily for their functional purpose.

In all industrial nations, there are specific engineering standards which must be met in the design and construction of a bridge. Bridges are intended to be structures which will not collapse during normal use, as well as foreseeable natural acts such as storms or other natural phenomena. Thus, bridges are designed to account for not only loading conditions which are always present (e.g., the dead load of the bridge and the live loads transmitted by users of the bridge), but also loading conditions created by wind, snow, or other natural weather conditions. One particularly devastating type of natural event which continues to cause destruction of even the most well designed bridges are earthquakes. While a bridge designer in some geographical locations may be forced to comply with certain standards to handle an earthquake, recent history has shown that a great majority of bridges are not designed to adequately withstand an earthquake even when the bridge design satisfies local engineering standards. As well understood by those skilled in the art, earthquake damage is primarily due to lateral shifting of manmade structures. Particularly in bridge designs, there is little consideration given to designing bridge abutments in order to minimize the damage which can be created by an earthquake.

Inherent in any bridge design is the desire to limit the lateral or transverse movement of the bridge superstructure so that the bridge superstructure moves as a single unit as opposed to a number of separate parts. Accordingly, there are numerous types of lateral supports (e.g., gussetts or baffles) found within bridge superstructures which extend substantially perpendicular to the girders of the bridge superstructure. The girders typically run in the direction of the gap to be spanned. During a seismic event like an earthquake, a great majority of the lateral force of the bridge superstructure is directly transferred to the bridge abutments. While the bridge girders, overlying decking and roadway may be able to withstand a particular seismic event, weakening or destruction of the bridge abutments will result in bridge superstructure damage or destruction simply due to the fact that the bridge superstructure is no longer properly supported at its respective ends by the abutments. Whether a bridge superstructure includes a single span or has multiple intermediate supports between the bridge abutments, preventing damage to the bridge abutments is critical in ensuring that the bridge superstructure can adequately withstand a seismic event.

SUMMARY OF THE INVENTION

In accordance with the present invention, an abutment is provided for use with a bridge superstructure wherein the abutment includes lateral containment elements which reinforce the abutment to prevent undesirable differential lateral displacement or movement of the bridge superstructure during a seismic event. The term "bridge superstructure" as used herein refers to the major structure of the bridge which rests upon the abutments and rests upon any intermediate supports. As understood by those skilled in the art, the bridge superstructure includes the girders, lateral supports, decking, and the roadway above the decking. It should also be understood that subsequent reference to the term "bridge" herein more specifically refers to the bridge superstructure. The differential lateral displacement or movement of the bridge during a seismic event refers to the additional lateral shifting or movement which is experienced by the bridge superstructure during a seismic event due to the fact that the bridge is not adequately restrained in its connection to the abutments. That is, during a seismic event the abutments themselves will also laterally shift in response to the shifting movement of the earth during the seismic event, and the differential displacement or movement of the bridge superstructure constitutes not only the additional magnitude of displacement of the bridge superstructure, but can also refer to the out of phase oscillation of the bridge in comparison to the abutments.

The lateral containment elements can be constructed of varying materials and can be represented herein as differing embodiments of the current invention. In a first embodiment of the invention, the bridge abutment may include lateral containment elements made of mechanically stabilized earth which extends laterally away from each lateral side or end of the sill of the abutment. The mechanically stabilized earth is confined within an area between the lateral ends of the sill and wing walls or wing extensions which extend away from each end of the facing wall of the abutment.

In a second embodiment of the invention, the lateral containment elements are reinforced concrete blocks which may be pre-fabricated for the particular bridge design, or may be poured in place at the job site. The concrete blocks may be further reinforced by the use of one or more micropiles which have an upper end encased within the concrete block and a lower end which extends below the abutment into the ground.

In yet another embodiment of the invention, the lateral containment elements are a plurality of steel piles or beams which are driven into the ground or emplaced in pre-drilled holes which abut or are placed directly adjacent to each lateral end of the sill. These steel piles are sized and spaced from one another in a manner which provides the desired level of lateral restraint to the superstructure of the bridge.

With respect to use of concrete blocks as the lateral containment elements, the concrete blocks may be placed on a flat surface of the abutment directly adjacent the sill, this flat surface preferably being at the same height as the sill. Alternately, the concrete blocks may extend below the level of the sill and into the ground or the mechanically stabilized earth beneath the flat surface. For concrete blocks which include a portion which extends below the flat surface, the portion extending below can be considered a shear key which further stabilizes the concrete block. Additionally, one or more micropiles could also be contained within the shear key and having a lower end which extends further below the shear key to provide yet additional anchor stabilization to the concrete block.

An additional feature of the invention, which may be incorporated for a bridge spanning a river which is subject to erosion by scour, is the use of a plurality of micropiles which are placed externally of the facing wall of the abutment and which extend downwardly into the ground below the river bed. In short, these scour micropiles help to stabilize the earth around the abutment and to prevent scour which could result in an undercut of the river channel with respect to the facing wall of the abutment.

Yet another feature of the invention which may be incorporated within the various embodiments is a modified bearing member of the sill which can extend into each of the lateral containment elements, thus providing further strength to the abutment design and enhancing the ability for horizontally transmitted loads from the bridge superstructure to be absorbed within the abutment.

For each of the embodiments of the invention, lateral stability and strength is provided to the abutment by lateral containment elements that are of simple yet effective design. Traditional bridge abutment designs may be supplemented by incorporating the lateral containment elements without having to substantially redesign the entire bridge abutment. A minimum amount of material and labor is required to install the lateral containment elements thus enhancing the ability of the invention to modify traditional bridge abutment designs.

Other features and advantages of the invention will become apparent from a review of the following description, taken in conjunction with the accompanying drawings.

DETAILED DESCRIPTION OF THE INVENTION

Figure 1:
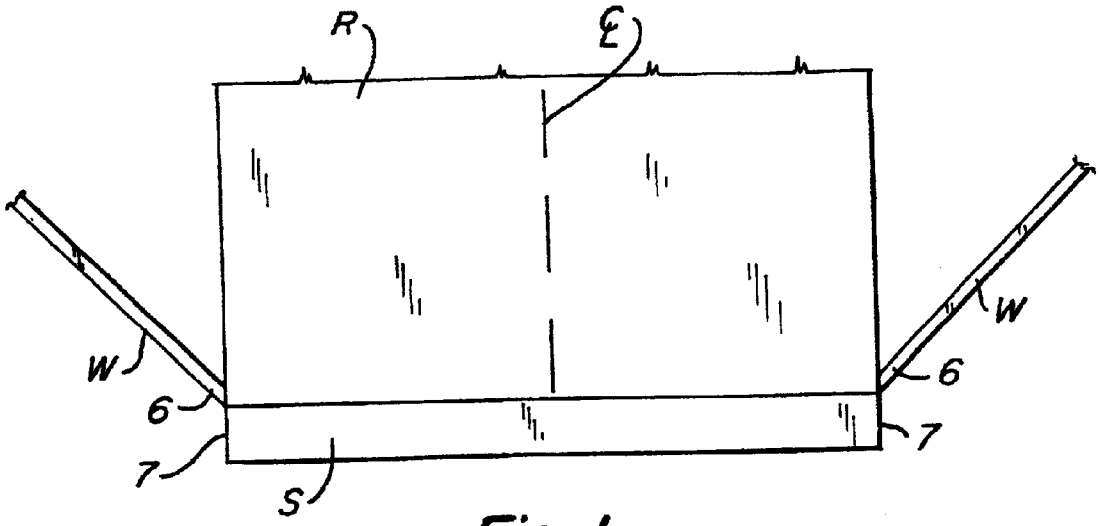
Fig 1 (PRIOR ART)
FIG. 1 is a simplified plan view of a prior art bridge abutment.
Figure 2:
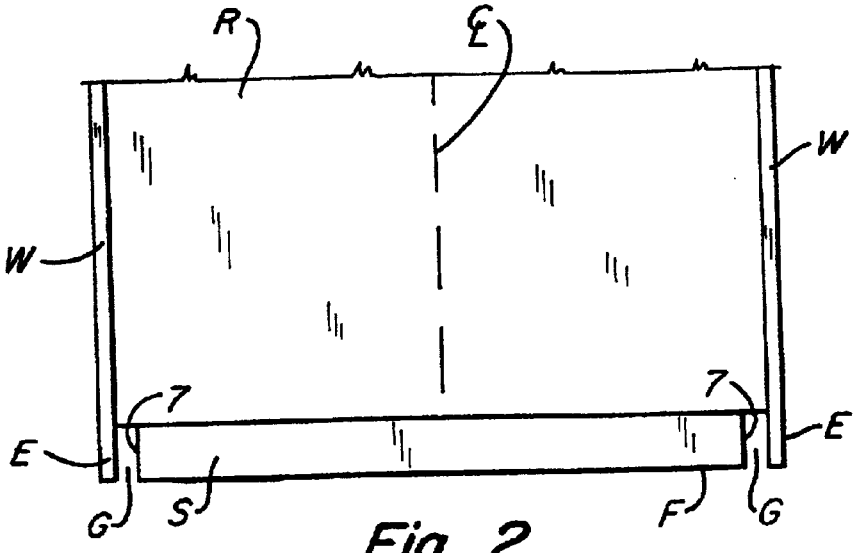
Fig 2 (PRIOR ART)
FIG. 2 is another simplified plan view of a prior art bridge abutment.

FIGS. 1 and 2 are simplified prior art Figures illustrating two common means by which an abutment is constructed. With respect to FIG. 1, the sill S of the abutment aligns with the roadway R, the center of the sill S being substantially bisected by the center line CL of the road. A pair of wing walls W extend laterally away from the roadway. The wing walls W begin at points 6 which do not reside laterally of the side edges 7 of the sill. Thus, the sill S of the bridge abutment has no lateral stabilization provided by the wing walls W, or any other abutment members.

Another common bridge abutment design is that shown in prior art FIG. 2 wherein the wing walls W may extend more longitudinally with respect to the direction of the roadway R, and may further include wing wall extensions E which extend forward to the front face F of the sill; however, these extensions E do not provide structural support to the sill. There may be even some gap G which exists between the extension E of the wing wall and the lateral edges 7 of the sill. Even if there is no gap between the wing wall W and the lateral edges 7, prior art FIG. 2 does not include any design considerations for providing lateral support to the bridge abutment, and the extensions E are provided purely for aesthetic purposes to hide the connection of the bridge girders to the sill S.

Figure 3:
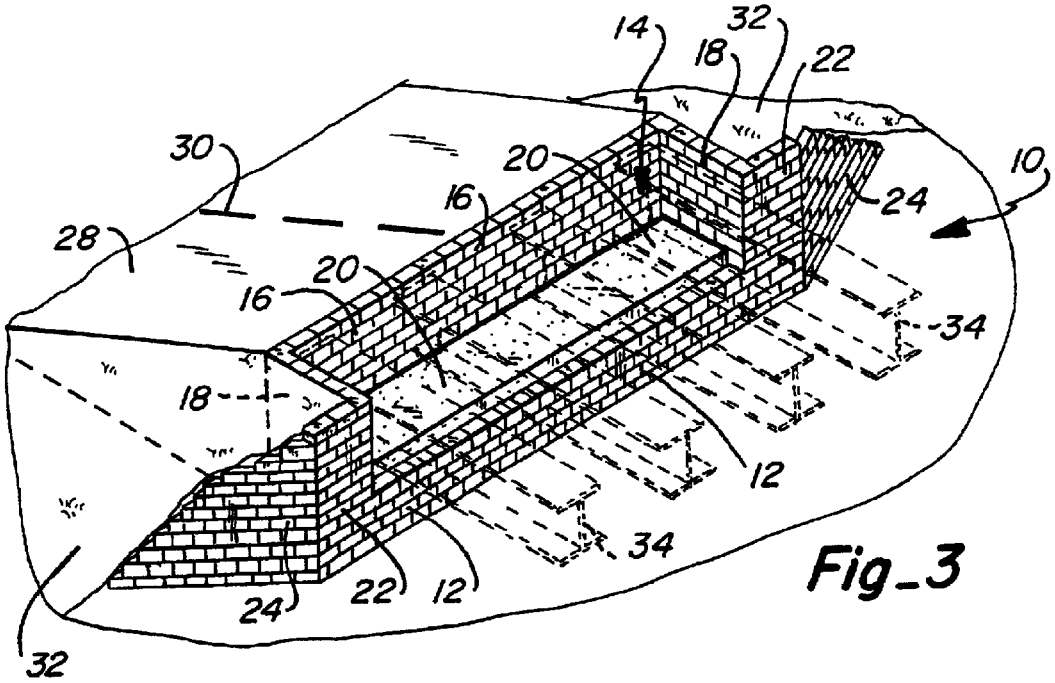
FIG. 3 is a perspective view of one preferred embodiment of the abutment of the present invention.
Figure 4:
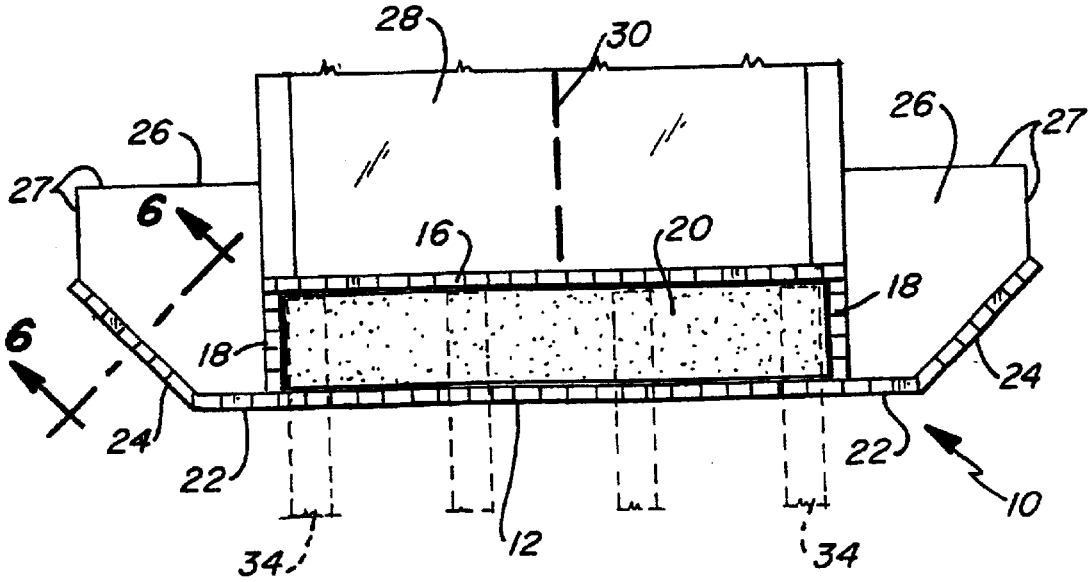
FIG. 4 is a plan view of the abutment shown in FIG. 3.
Figure 5:
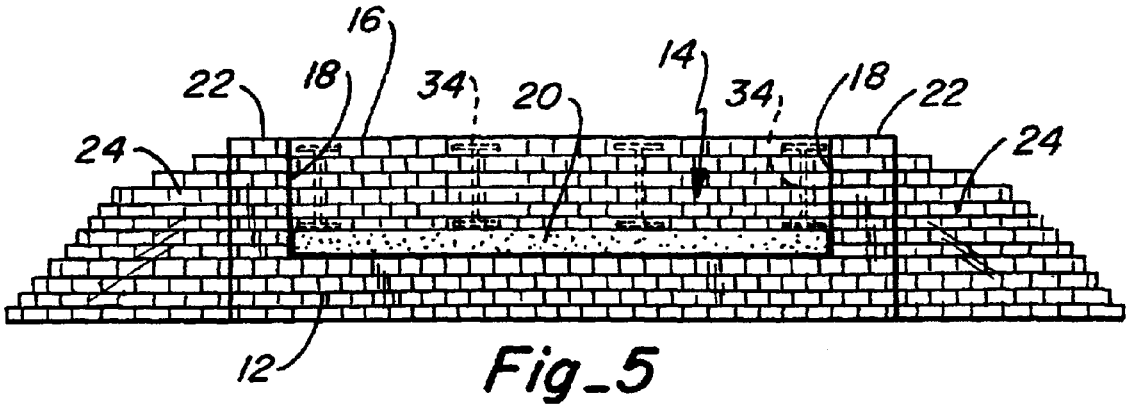
FIG. 5 is a front elevation view of the abutment of FIG. 3.

In accordance with the present invention, FIGS. 3 and 4 illustrate a first embodiment of the abutment with seismic restraints. The abutment 10 includes a facing wall 12, which extends below the sill 14. The facing wall 12 further includes facing wall sections 22 which define the front edges of the lateral containment elements 26, as well as facing extensions or wing wall extensions 24 which define the lateral sides of the lateral containment elements 26. As shown in FIG. 4, the lateral containment elements 26 for the first embodiment correspond to the cross hatched areas. The lateral containment elements 26 may extend rearwardly towards the road 28 a desired distance, lines 27 illustrating the extent of the rearward extension. As further discussed below, the lateral containment elements 26 in the first embodiment are constructed of mechanically stabilized earth which is formed in a layer by layer construction method beginning with a most lower level or layer.

As also shown in FIGS. 3 and 4, the sill 14 is delimited by a rear wall 16, and a pair of side walls 18. Sill 14, rear wall 16, and side walls 18 can be collectively defined as a retaining enclosure or fortress which receives the ends of the bridge girders 34. Typically, the sill 14 includes a bearing sill member 20 which may simply be a slab of reinforced concrete. The girders 34 rest directly upon and are secured to the bearing sill member 20 as well understood by those skilled in the art. As shown in FIGS. 3 and 4, the center line 30 of the road 28 substantially bisects the sill 14.

FIG. 3 also illustrates one manner in which the abutment 10 of the present invention can be incorporated within the grade of the land surrounding the abutment. As shown, there may be a downward sloping surface 32 which extends laterally away from both sides of the roadway and the abutment. Thus, wing extensions 24 diminish in height as they extend laterally away from the sill.

Preferably, the girders 34 of the bridge extend in height to a level which is just below the upper edge of the retaining enclosure. Thus, any lateral forces produced by the bridge during a seismic event can be absorbed by the abutment along the entire height of the girders 34. FIG. 3 illustrates four girders with the abutment of the invention; however, it shall be understood that the length of the sill can be adjusted in order to accommodate the particular design of the bridge girders to include their particular spacing and number. Preferably, the pair of outside girders are in contact with side walls 18. This abutting relationship of the outside pair of girders and the side walls 18 ensures that there is minimum acceleration and displacement of the bridge during a seismic event which is not immediately absorbed by the abutment. The figures do not show the additional superstructure of the bridge to include the decking, or the transverse elements which tie the girders to one another. However, such additional detail of the bridge is unnecessary to appreciate the current invention which is adapted to receive any type of bridge girder arrangement.

Figure 6:
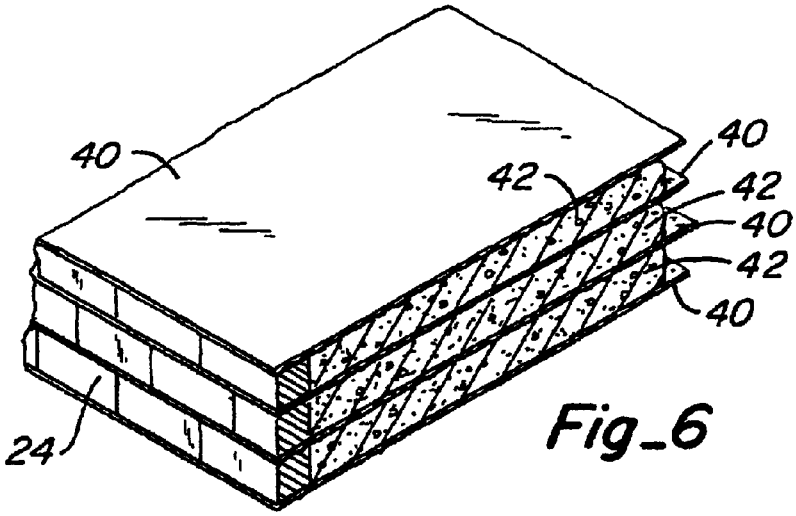
FIGS. 6 and 7 are greatly enlarged fragmentary perspective views taken along line 6—6 of FIG. 4 illustrating two methods by which the lateral containment elements may be reinforced with mechanically stabilized earth.
Figure 7:
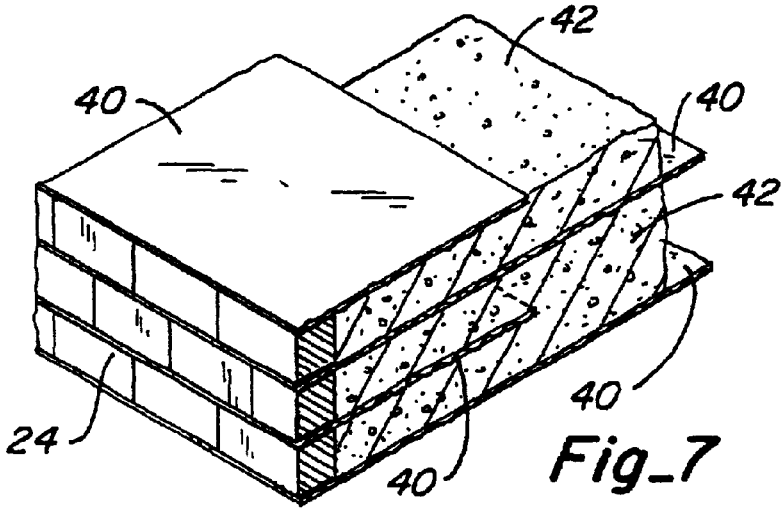

FIGS. 6 and 7 illustrate some preferred ways in which the lateral containment elements 26 can be constructed of mechanically stabilized earth. As shown in FIGS. 6 and 7, the facing 24 may comprise a wall made of concrete masonry units (CMUs) which are well known in the art, and are similar to cinder blocks. Sheets of geo-textile material 40 may be used along with well compacted granular fill 42 which is placed between the sheets 40. Thus, the lateral containment elements 26 can be built as "bottom up" structures which are constructed in layers beginning with the bottom most layer by sequentially placing the layers of geo-textile material and the intermediate layers of compacted fill. Preferably, the facing materials are placed without mortar to maximize the flexibility of the mechanically stabilized earth structure.

In addition to the geo-textile sheets, other sheet materials may be used to form layers within the mechanically stabilized earth for example, geo-grid material, steel mesh, and steel strips may be used. Each of these other types of sheet materials also have high tensile strength and work well in creating a structure of mechanically stabilized earth.

In addition to CMUs, a number of other facing materials can be used in the abutment of this invention. For example, proprietary concrete blocks, quarried stone, or even timbers may be used as the facing material for the abutment.

Figure 8:
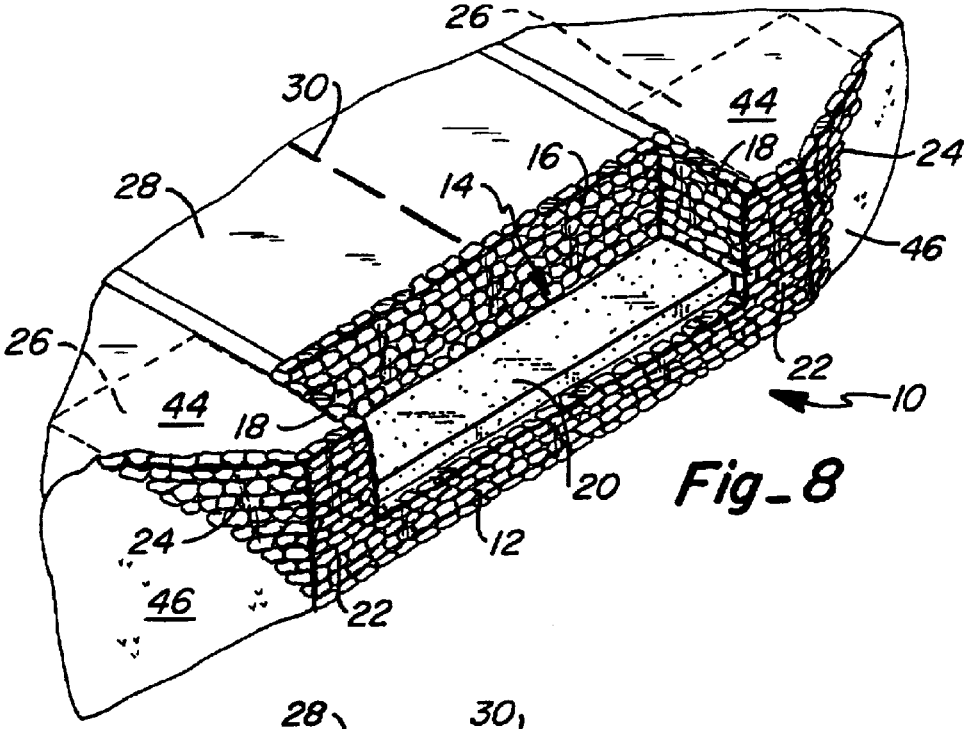
FIG. 8 is another perspective view of the first embodiment of the invention, illustrating a variation of how the facing wall and wing extensions of the abutment can be incorporated within the particular grade and sloping surfaces surrounding the abutment, and further showing an alternate facing material in the form of quarried stone blocks.

FIG. 8 illustrates the first embodiment of the invention, but using a different facing material such as quarried stone. Additionally, FIG. 8 illustrates an alternate construction for the lateral containment elements wherein the upper surface 44 is substantially flat and is substantially continuous with the elevation of the roadway 28, while a secondary sloping surface 46 slopes downwardly from the rear of the abutment towards the front face of the abutment. Accordingly, wing extensions 24 diminish in an upwards and rearwards fashion in comparison to the wing extensions shown in FIG. 3. As with the abutment shown in FIG. 3, the lateral containment elements of FIG. 8 are made of mechanically stabilized earth.

Although the first embodiment contemplates use of mechanically stabilized earth, it should also be understood that other means may be used to fill the gap between the wing extensions and the respective lateral sides of the abutment, and which may still provide the required strength for the lateral containment elements. For example, particularly for smaller bridge constructions, it may be adequate to simply emplace compacted fill, or a combination of compacted fill along with large rocks or boulders which are evenly distributed throughout the fill. Furthermore, in lieu of compacted earth, the area defined by lateral containment elements 26 could be completely filled with concrete or soil stabilized with a combination of a soil lime or soil concrete combination.

Figure 9:
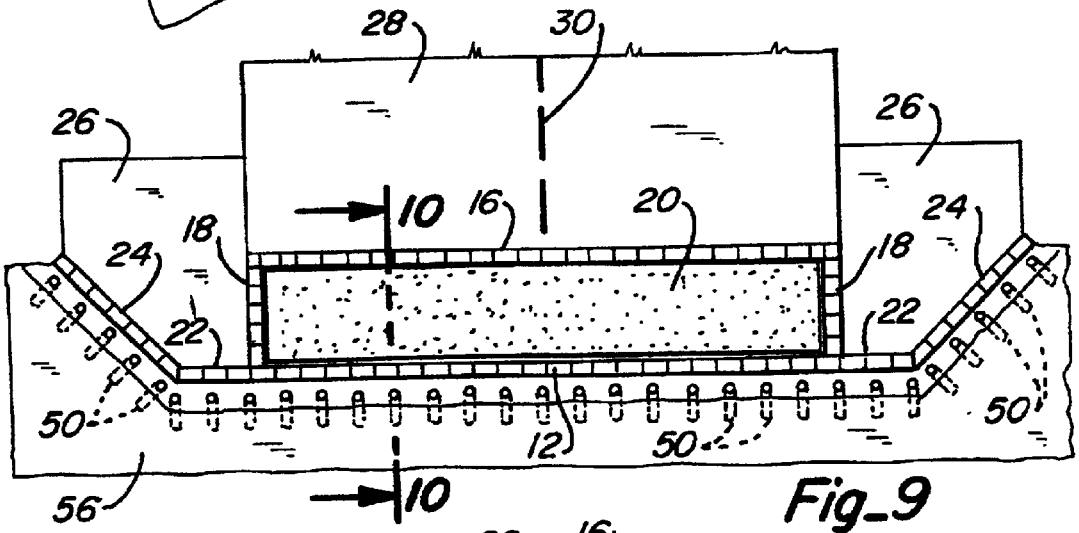
FIG. 9 is a plan view of the abutments of FIG. 3 further illustrating a reinforcing micropile construction which may be positioned exteriorly of the facing wall of the abutment to prevent scour which may be caused by a body of water such as a river or stream.
Figure 10:
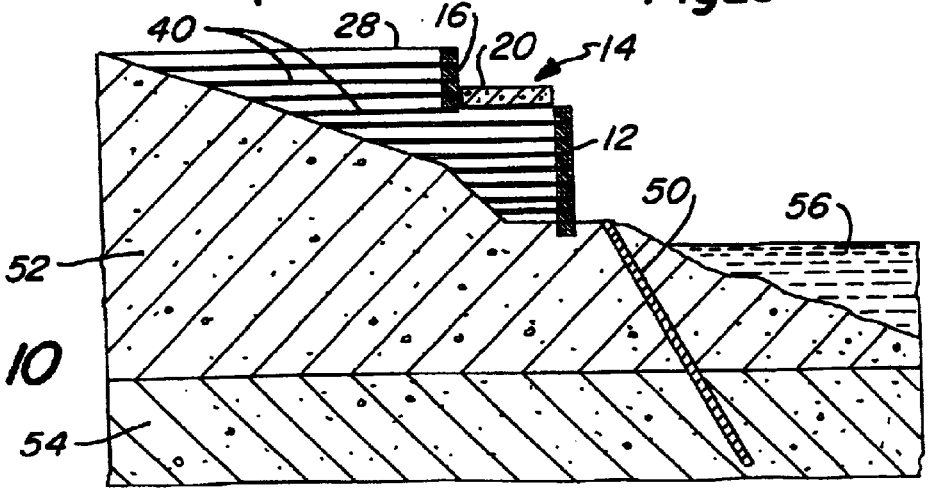
FIG. 10 is a vertical section taken along line 10—10 of FIG. 9 illustrating details of the micropiles driven adjacent the abutment, and also illustrating the interior construction of the abutment including various layers of reinforcing material, such as geo-textile layers.

In addition to the construction of the abutment itself, it may also be necessary to stabilize the ground around the abutment to prevent the scouring action of a body of water, such as a river. In such a case, it is advantageous to use a plurality of scour micropiles 50 which surround the front face of the abutment, as shown in FIG. 9. The micropiles 50 can be sized and spaced around the front face of the abutment to stabilize and hold the earth extending under and beyond the abutment 10 in the direction of the road 28. FIG. 10 illustrates the way in which the micropiles may extend angularly away from the abutment to prevent undesirable scour. As shown, a subgrade 52 is penetrated by the micropile 50. The angular displacement of the micropile 50 may extend to a distance which actually terminates directly underneath a portion of the body of water 56. An underlying layer of earth 54 is also shown, for purposes of indicating that it may be desirable to have the micropile 50 penetrate a more dense layer which underlies the sub grade 52. Of course, the particular geology of a river bed in terms of its underlying layers of earth do not limit the present invention to one in which there is a distinct sub grade and an underlying rock or dense layer 54. The micropiles 50 will substantially prevent scour from encroaching upon the abutment even with the micropiles 50 extending into a single layer or type of sub grade material. FIG. 10 as shown in the cross section also illustrates the horizontally extending layers of reinforcing sheets 40. Thus in the case of FIG. 10, reinforcing sheets are used for construction of the lateral containment elements 26, the earth underlying the sill 14, and the earth which extends rearwardly from the rear wall 16.

Figure 11:
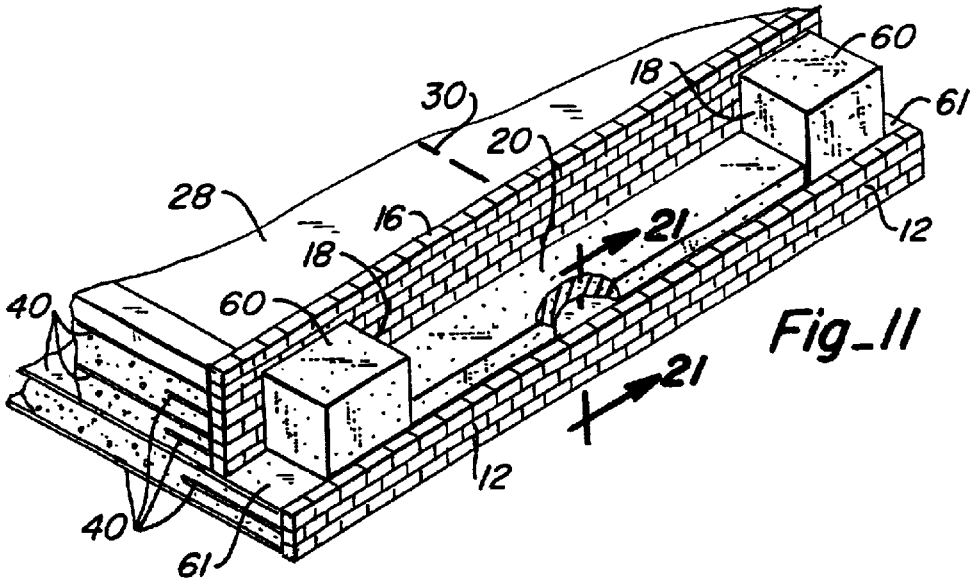
FIG. 11 is a perspective view and a fragmentary vertical section of the left side of the abutment illustrating another preferred embodiment of the invention.

FIG. 11 illustrates another preferred embodiment with respect to the abutment of the current invention. For this particular embodiment, the lateral containment elements 60 are in the form of reinforced concrete blocks which abut each lateral end of the sill, and which therefore also form side walls 18. These concrete blocks 60 may be prefabricated for the particular abutment design, and then transported to the job site for emplacement upon mechanically stabilized earth which underlies the sill and portions which extend laterally away from the sill, illustrated as extensions 61. The left side of FIG. 1 shown in cross section illustrates the mechanically stabilized earth which underlies the sill and the extensions 61. Also shown is mechanically stabilized earth which extends rearwardly from wall 16 and under the approach of the road 28; however, it shall be understood for purposes of preventing undesirable lateral displacement of the bridge, it is not a requirement that mechanically stabilized earth be used for all portions of the abutment.

Figure 12:
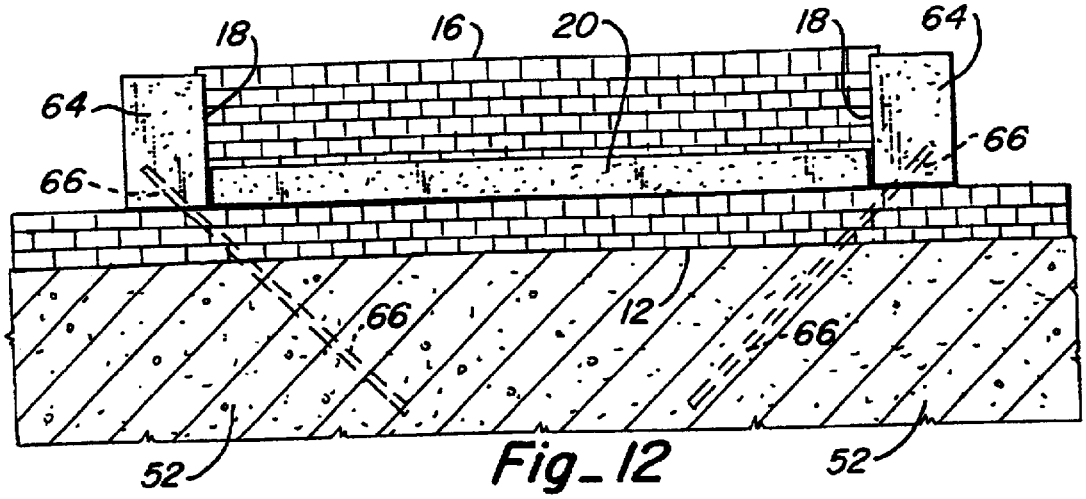
FIG. 12 is a elevation view of a modification to the embodiment of FIG. 11, including a vertical section of the earth beneath the abutment, the modification including one or more micropiles connecting to the lateral containment devices and anchored in the ground.

FIG. 12 is a modification of the embodiment shown in FIG. 11. Specifically, FIG. 12 shows lateral containment elements 64 made of reinforced concrete blocks which incorporate one or more micropile tie downs 66 having upper ends embedded within the concrete blocks, and having lower ends which extend angularly downward. One method of constructing the abutment shown in FIG. 12 would be to first construct the facing 12 including the mechanically stabilized earth, driving the micropile tie downs 66, and then emplacing the concrete blocks wherein the blocks have pre-drilled holes for receiving the upper ends of the micropile tie downs 66. By also incorporating the micropiles 66, the size of the concrete blocks can be reduced because the anchoring effect of the micropiles contributes to the lateral strength of the containment elements. Without the use of the micropiles 66, it is the weight of the concrete blocks which determines their lateral stabilizing effect upon the bridge.

Figure 13:
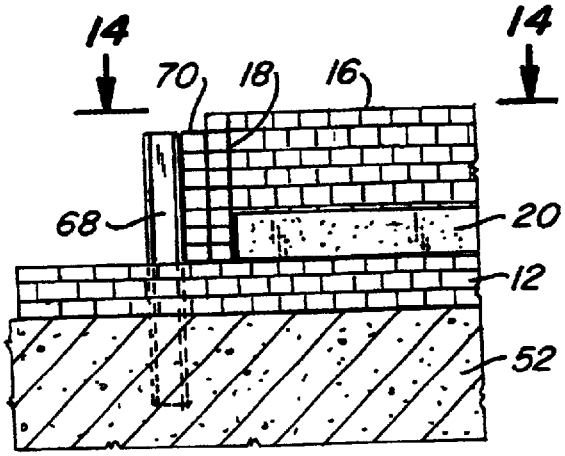
FIG. 13 is a left side fragmentary elevation view of yet another preferred embodiment of the invention which includes steel piles or beams as the lateral containment elements, and further illustrating a partial vertical section of the ground underneath the abutment showing the steel piles anchored in the ground.
Figure 14:
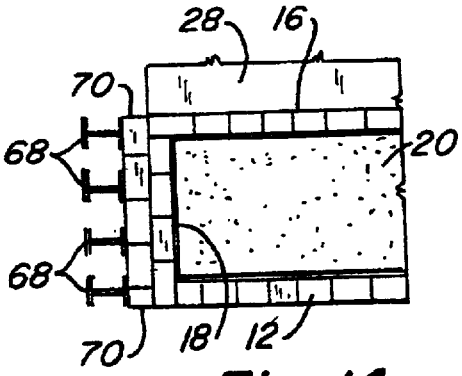
FIG. 14 is a fragmentary left side plan view of the embodiment of FIG. 13.
Figure 15:
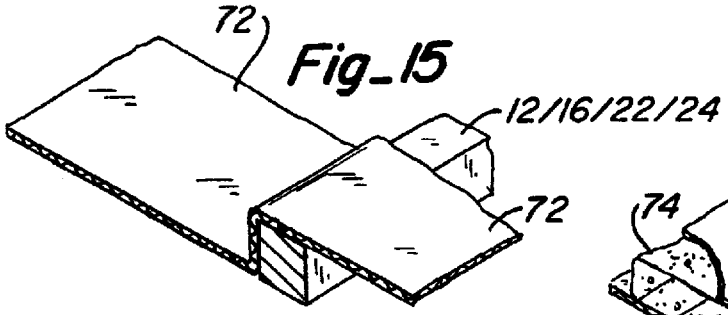
FIGS. 15–20 are enlarged fragmentary perspective views illustrating another method by which the abutment may be constructed in a layer by layer, bottom up construction sequence.
Figure 16:
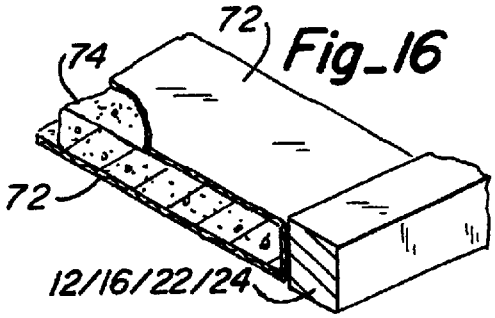
Figure 17:
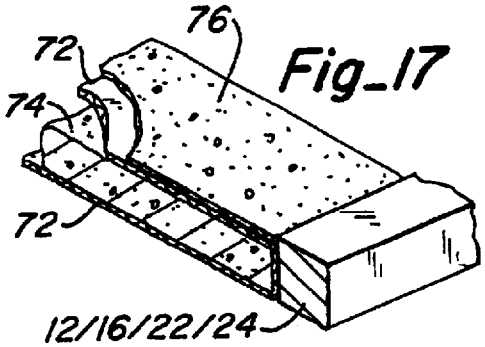
Figure 18:
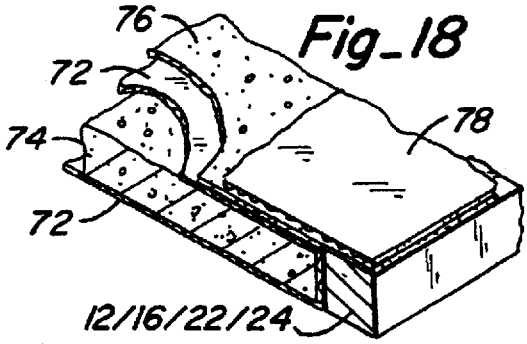
Figure 19:
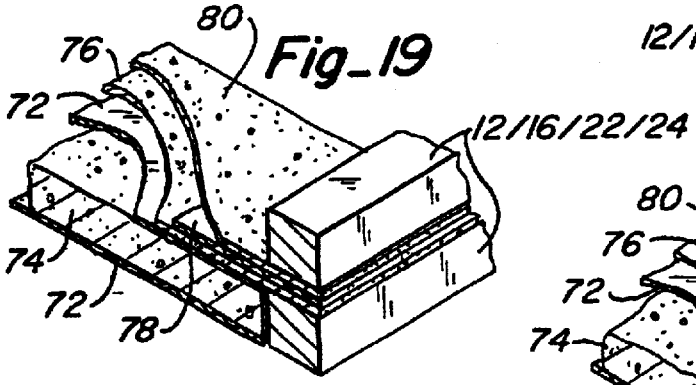
Figure 20:
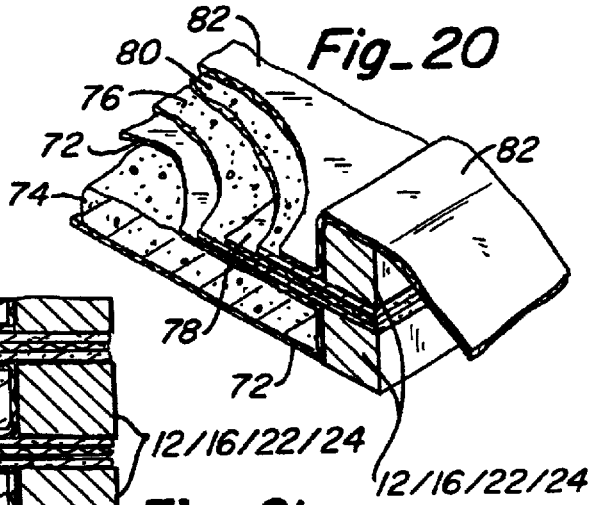

FIG. 13 illustrates another preferred embodiment of the invention which utilizes lateral containment elements 68 in the form of steel beams or piles which are received in pre drilled holes directly adjacent the lateral ends of the sill, or the beams may be driven into the ground. Beams 68 may be placed in contact with the lateral sides of the sill, or may be slightly spaced from the lateral sides of the sill and then some connecting elements such as an additional row of CMUs are used to ensure there is contact between the beams 68 and the lateral sides of the sill so that loads can be transmitted directly from the sill to the beams. As shown in FIG. 13, an additional vertical wall 70 of CMUs is provided between the beams 68 and the side wall 18.

Figure 21:
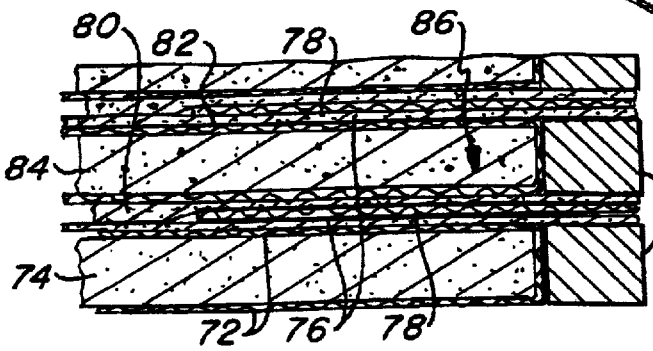
FIG. 21 is an enlarged fragmentary vertical section illustrating a section of the facing wall taken along line 21—21 of FIG. 11, and also illustrating the construction method as shown in FIGS. 15–20.

In addition to the basic methods shown in FIGS. 6 and 7 as to construction of mechanically stabilized earth used with the abutment of the invention, one particularly advantageous construction of mechanically stabilized earth is shown in FIGS. 15–21. Beginning first with FIG. 15, some portion of the abutment 12/16/22/24 is provided with a lower first level of CMUs or other facing material. A first reinforcing layer 72 extends rearwardly from the facing, and a portion of the first reinforcing layer is allowed to extend over the front edge of the facing. A first compacted fill or lift 74 is then added to back fill the first facing level. The excess portion of the first reinforcing layer 72 is then pulled back over the first compacted lift 74. A thin layer of fill 76 is then placed over the folded back layer 72. Next, a second reinforcing layer 78 may be placed over the upper edge of the facing material and extends back a desired distance from the facing material. For this second reinforcing layer 78, it does not extend as far rearwardly as the first reinforcing layer 72. A second thin layer of fill 80 is placed upon the second reinforcing layer 78. Another level of CMUs or other facing material is then stacked upon the first level of facing materials. The construction of the mechanically stabilized earth as shown in FIGS. 15–19 is then repeated by first placing yet another reinforcing layer, shown as layer 82. FIG. 21 illustrates the mechanically stabilized earth structure and two levels or layers of facing material. The closely spaced grouping of reinforcing layers and the thin layers of fill between the reinforcing layers can be defined collectively as a boundary layer 86. As shown, this boundary layer 86 resides at the interface or junction between the facing material layers.

FIGS. 22–27 illustrate each of the previous embodiments and modifications discussed above wherein the bearing sill member 20 is lengthened such that it extends into the lateral containment elements. The bearing sill member in these figures is illustrated as an extended bearing sill member 90 including extensions 92 which traverse or extend into the various lateral containment elements. The purpose of providing an extended bearing member 90 is to better ensure that lateral forces transmitted by the bridge superstructure to the sill ultimately are transmitted to the lateral containment elements.

Figure 22:
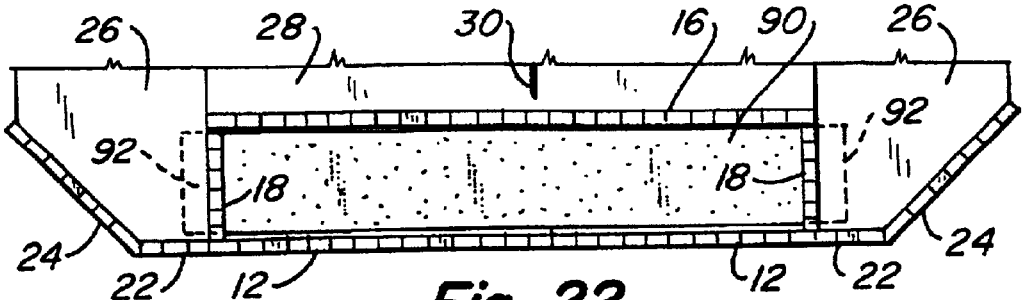
FIG. 22 is a plan view of the abutment shown in FIG. 3 which incorporates a modified bearing sill member which extends into the lateral containment elements.

As shown in FIG. 22 with respect to lateral containment elements 26 made of mechanically stabilized earth, the extensions 92 extend into a portion of the lateral containment elements 26. Thus in the construction of the layers, extensions 92 are simply covered with above layers of compacted fill and sheets of reinforcing material.

Figure 23:
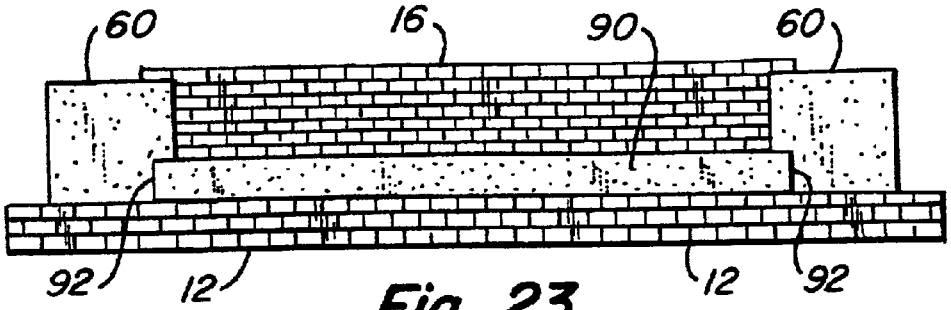
FIG. 23 is an elevation view of the abutment shown in FIG. 22.
Figure 24:
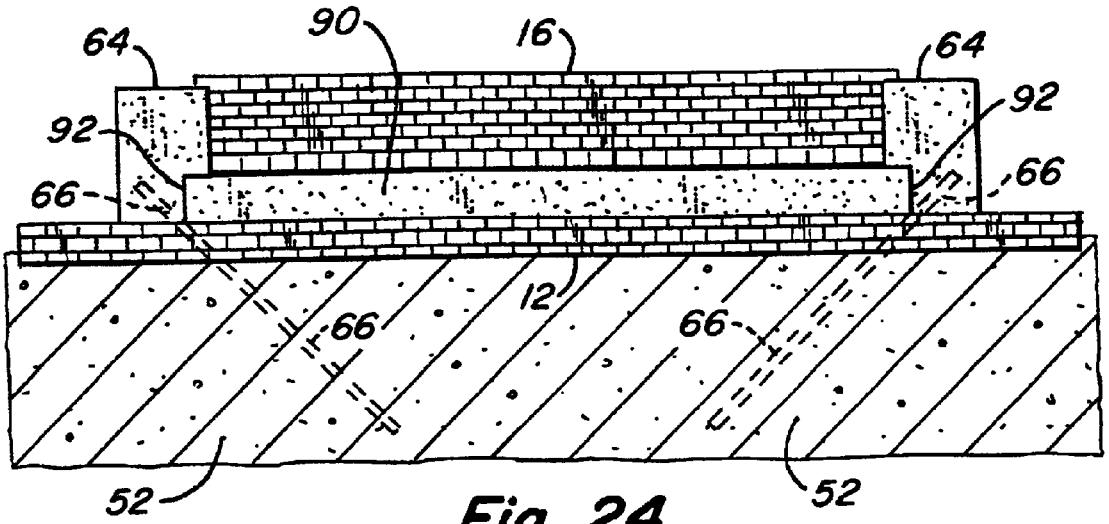
FIG. 24 is another elevation view similar to FIG. 12, illustrating the modified bearing sill member used with a concrete block lateral containment element which also incorporates a micropile reinforcement.

FIG. 23 illustrates lateral containment elements 60 which have a groove or notch formed therein to accommodate the extensions 92. FIG. 24 illustrates lateral containment elements 64 which also have a groove or notch formed therein to accommodate the extensions 92.

Figure 25:
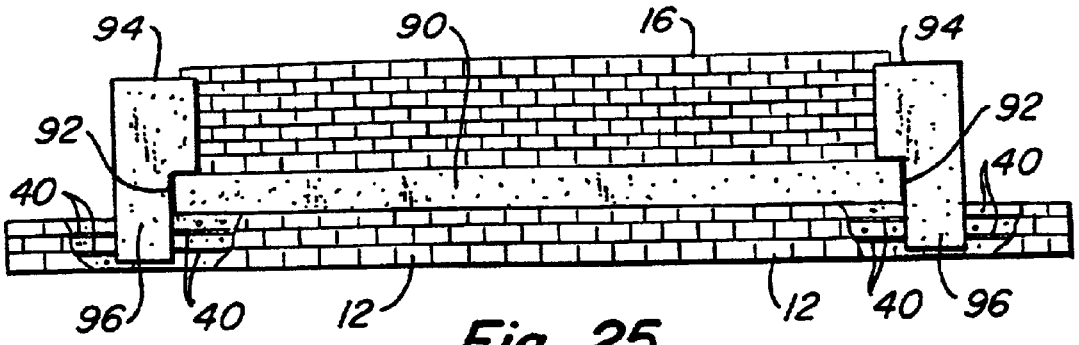
FIG. 25 is an elevation view similar to FIG. 23, but illustrating the use of a shear key which extends into the mechanically stabilized earth as a means to further reinforce the lateral containment elements, the facing wall of the abutment illustrated as broken away to show the extension of the shear key.

In FIG. 25, the extensions 92 are also shown extending into lateral containment elements 94; however, these lateral containment elements have also been modified to include lower portions 96 defining shear keys which extend into the mechanically stabilized earth. These shear keys 96 provide additional strength to the containment elements 94, and allows the containment elements 94 to be of smaller size because their ability to withstand lateral forces is not solely dependent upon the mass of the concrete blocks. It should also be understood that the use of a shear key 96 can be used with a bearing member 20 which does not extend into the respective lateral containment elements.

Figure 26:
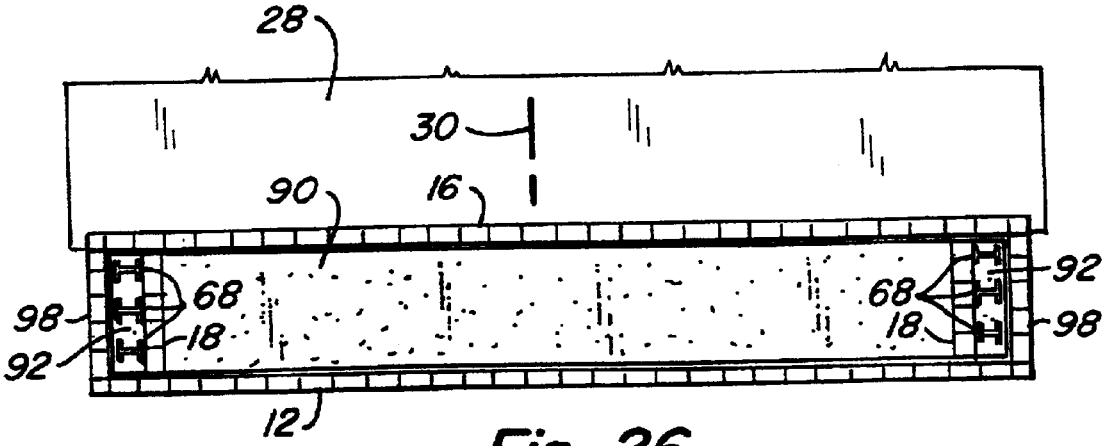
FIG. 26 is a plan view illustrating the use of steel piles as lateral containment elements, and the modified bearing sill member which extends to and beyond the piles.
Figure 27:
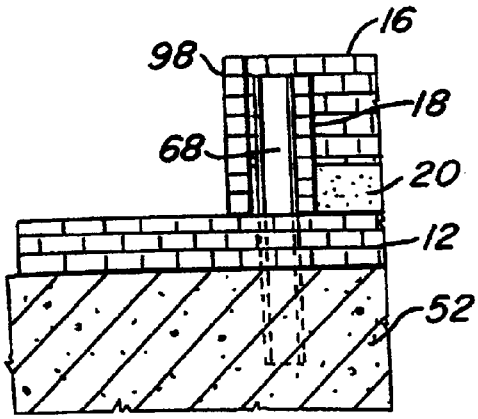
FIG. 27 is an elevation view of FIG. 26.

FIGS. 26 and 27 illustrate the bearing member 90 wherein the extensions 92 traverse laterally beyond the steel beams 68. One method of constructing the bearing member 90 for this embodiment would be to pour the concrete slab of the bearing member 90 after the beams 68 had been emplaced. Additionally, for aesthetic purposes, an external lateral wall 98 may be provided to hide the steel beams.

For each of the embodiments, the lateral containment elements must be able to withstand the forces generated from a seismic event which is typical for the particular geographical location in which the bridge is to be installed. Accordingly, there must be given consideration to not only the total mass of the bridge superstructure which will produce the lateral forces on the abutments, but also the seismic coefficient which is provided by local design codes for determining a design horizontal seismic acceleration.

Below are sample calculations which provide a theoretical horizontal load applied to the lateral containment elements, and the lateral support provided by the lateral containment elements to withstand the theoretical horizontal load.

Sample Calculations:

1. Assume a particular bridge superstructure has a total weight of: W=1,000,000 lbf
   a. Total bridge mass is therefore:

$$W_m = \frac{W}{\sec^2}$$

$W_m$=9.992×10$^5$ lb b. Bridge mass on single abutment:

$$w_m = \frac{W_m}{2}$$

$W_m$=4.996×10$^5$ lb c. Assume a particular seismic coefficient—(given by local agencies according to design codes which predict a seismic event)
   α=0.25

The design horizontal seismic acceleration is therefore:

$$a = \alpha \cdot 32.2 \frac{\text{ft}}{\sec^2} \quad a = 8.05 \frac{\text{ft}}{\sec^2}$$

d. Assume the following angles for the abutment design:
   Internal friction angle of MSE fill: Φ:=37 deg
   Interface friction angle at base of sill: δ=⅔Φ δ=24.6687 deg
   e. The frictional resistance to lateral displacement can be defined by the following equation:

$$F = \frac{W}{2} \cdot 1.5a \cdot \tan(\delta) \quad F = 8.611/\times 10^4 \text{ lbf}$$

f. The horizontal load applied to a lateral containment element based upon a seismic event with the above seismic coefficient and bridge mass can be defined by the following equation:
   $P_h$=$w_m$·a−F $P_h$=3.889×10$^4$ lbf 2. Design specifications for lateral support provided by a lateral containment element utilizing mechanically stabilized earth (MSE):
   a. Height of MSE fill above bottom of sill: H=8 ft
   b. Geosynthetic reinforcement width: $w_s$=12 ft
   c. Lateral containment element thickness (thickness of facings 22 and 24 as measured from front edge to rear edge) B=5 ft
   d. Unit weight of MSE fill:

$$\gamma = 120 \frac{\text{lbf}}{\text{ft}^3} \quad psf = \frac{\text{lbf}}{\text{ft}^2}$$

e. Sliding capacity of MSE wing wall: $P_{sl}$=γ·H·$w_s$·B·tan(Φ)
   $P_{sl}$=4.34×10$^4$ lbf
   f. Factor of safety against sliding:

$$FS_{sl} = \frac{P_{sl}}{P_h} \quad FS_{sl} = 1.116$$

Therefore, based upon the design set forth above, the MSE lateral containment element is designed to withstand the theoretical horizontal load of a predicted seismic event.

3. Design specifications for lateral support provided by lateral containment element utilizing concrete block:
   a. Concrete block height—$H_c$=8 ft
   b. Concrete block width—$w_c$=10 ft
   c. Concrete block depth—$B_C$=8 ft $$pcf = \frac{1bf}{\text{ft}^3}$$

d. Unit weight of concrete—γc=145 pcf
   e. Concrete block weight—$W_c$=$H_c$·$w_c$·$B_c$·$\gamma_c$
   $W_c$=9.28×10$^4$ lbf
   f. Sliding capacity of concrete block—$P_{sl_}$c=$W_c$·tan(δ)
   $P_{sl_}$c=4.262×10$^4$ lbf
   g. Factor of safety against sliding—

$$FS_{sl} = \frac{P_{sl_c}}{P_h} \quad FS_s l = 1.096$$

4. Design specifications for lateral support provided by lateral containment element utilizing concrete block with micropile tiedowns:
   a. Concrete block height—$H_c$=4 ft
   b. Concrete block width—$w_c$=5 ft
   c. Concrete block depth—$B_c$=3 ft
   d. Unit weight of concrete—$\gamma_c$=145 pcf
   e. Concrete block weight—$W_c$=$H_c$·$w_c$·$B_c$·$\gamma_c$ $W_c$=8.7×10$^3$ lbf
   f. Sliding capacity of concrete block—$P_{sl_}$c=$W_c$·tan(δ)
   $P_{sl_}$c=3.995×10$^3$ lbf
   g. Number of tiedowns—$n_t$=3
   h. Micropile tiedown cross-sectional area—$A_t$=0.79 in$^2$
   i. Tiedown anchor yield—$f_y$=50,000 psi
   j. Allowable yield reduction—$y_r$=0.55
   k. Tiedown anchor capacity—$P_t$=$f_y$·$y_r$·$n_t$·$A_t$ $p_t$=6.518×10$^4$ lbf
   l. Factor of safety against sliding—

$$FS_{sl_t} = \frac{P_{sl_c} + p_t}{P_h} \quad FS_{sl_t} = 1.779$$

5. Design specifications for lateral support provided by utilizing concrete block with shear key extension:
   a. Height of concrete block above bottom of sill: H=8 ft
   b. Concrete block shear key extension: $H_2$=3 ft
   c. Concrete block width: $w_c$=8 ft
   d. Unit weight of MSE fill:

$$\gamma = 120 \frac{\text{lbf}}{\text{ft}^3}$$

e. Distance from key to edge of reinforced fill: $L_k$=6 ft
   f. Passive resistance:

$$P_p = \left(H \cdot L_k + \frac{H_2 \cdot L_k}{2}\right) \cdot w_c \cdot \gamma \cdot \tan(\Phi)$$

$P_p$=4.123×10$^4$ lbf g. Factor of safety against passive failure:

$$FSp = \frac{Pp}{P_h} \quad FSp = 1.06$$

6. Design specifications for lateral support provided by lateral containment element utilizing steel piles or beams:

a. Pile height above bottom of sill—$H_1$=8 ft b. Number of piles on each side of abutment—$n_p$=3 c. Moment in pile—

$$M_p = \frac{P_h}{H_l} \cdot \frac{(H_l + 3 \cdot ft)^2}{2} \quad M_p = 2.941 \times 10^5 ft \cdot lbf$$

d. Pile steel section—W12×30 e. Pile section modulus—$S_\chi$=38.6 $in^3$ f. Pile steel yield—$f_{yp}$=50,000 psi g. Pile yield reduction—$yr_p$=0.8 h. Individual pile bending capacity—$M_{pcap}=yr_p \cdot f_{yp} \cdot S_\chi$ $M_{pcap}=1.287\times10^5$ ft·lbf i. Total pile bending capacity—$M_{total}=M_{pcap}-_{hp}$ $M_{total}=3.86\times10^5$ ft·lbf j. Factor of safety against bending—

$$FS_m = \frac{M_{total}}{M_p} \quad FS_m = 1.312$$

From the foregoing calculations, it can be seen that an adequate factor of safety can be provided by designing the various lateral containment elements to withstand a predicted horizontal load applied by a bridge superstructure of a particular total mass, and considering the predicted seismic event based upon a seismic coefficient given by local authorities according to seismic design standards for the geographical area.

The foregoing example calculations are not intended to provide specific design limitations for the preferred embodiments, but simply are provided to show the design considerations which are taken into account in designing the size of the lateral containment elements based upon the particular mass of the bridge superstructure and the predicted seismic event.

This invention has been described with respect to particular embodiments thereof; however, it shall be understood that various other modifications may be made within the spirit and scope of the invention.

What is claimed is:

1. An abutment for use in a bridge that interconnects a roadway extending along a centerline, said abutment comprising:

a facing wall extending substantially vertically from the ground and substantially perpendicular to the centerline;

a retaining enclosure formed in said facing wall, said retaining enclosure having a horizontally extending sill aligned substantially perpendicular to said centerline, said sill having first and second side walls forming opposing ends of said sill, and a rear wall interconnecting said side walls;

a first lateral containment element connected to said first sidewall;

a second lateral containment element connected to said second sidewall; and said lateral containment elements each including a wing wall extending laterally away from the respective ends of said sill and laterally beyond the roadway, and mechanically stabilized earth filling gaps defined by spaces between the wing walls, the respective ends of the sill, and edges of the roadway, said lateral containment elements being designed to handle a seismic load that can be applied to said elements during a seismic event said design incorporating a seismic coefficient, a total mass of the bridge, and frictional resistance to lateral displacement.

2. An abutment, as claimed in claim 1, wherein:

each said lateral containment elements further include a plurality of piles having a first end contained in the abutment, and a second end extending downwardly and away from the abutment.

3. An abutment, as claimed in claim 1, further including:

a plurality of piles positioned around and spaced from a first face of the abutment to prevent scour.

4. An abutment, as claimed in claim 3, wherein:

at least one of said plurality of piles is connected to a portion of the facing wall extending below the sill by mechanically stabilized earth.

5. An abutment, as claimed in claim 1, further including:

a bearing member resting on said sill and extending laterally beyond said retaining enclosure through the respective side walls defining the opposing ends of said retaining enclosure, and said bearing member further extending into the lateral containment elements.

6. An abutment, as claimed in claim 1, wherein:

said sill includes a slab of reinforced concrete.

7. An abutment, as claimed in claim 1, wherein:

said facing wall includes a first portion extending below the sill and having first and second ends, second portions extending laterally away from said first and second ends of said first portion, facing wing extensions extending laterally away from each said second portions, and mechanically stabilized earth being emplaced behind said facing wall to support said facing wall along said first portion, said second portions, and said facing wing extensions.

8. An abutment for use in a bridge that interconnects a roadway extending along a centerline, said abutment comprising:

a facing wall extending substantially vertically from the ground and substantially perpendicular to the centerline;

a retaining enclosure formed in said facing wall, said retaining enclosure having a horizontally extending sill aligned substantially perpendicular to the centerline, said sill having first and second side walls forming opposing ends of said sill, and a rear wall interconnecting said side walls;

a first means for limiting lateral displacement of the bridge connected to one end of said sill;

a second means for limiting lateral displacement of the bridge connected to the other end of said sill; and wherein said first and second means for limiting lateral displacement of the bridge are sized in design to satisfy seismic design standards including a design that incorporates a seismic coefficient $\alpha$ and a total mass of the bridge $w_m$, the seismic coefficient and total bridge mass substantially determining a seismic horizontal load $P_h$ which could be applied to said first and second means for limiting lateral displacement of the bridge during a seismic event.

9. An abutment, as claimed in claim 8, wherein:

said first and second means for limiting lateral displacement of the bridge each include a wing wall extending laterally away from the respective ends of said sill and laterally beyond the roadway, and mechanically stabilized earth filling gaps defined by spaces between the wing walls, the respective ends of the sill, and edges of the roadway.

10. An abutment, as claimed in claim 8, wherein:

said first and second means for limiting lateral displacement of the bridge each include a concrete reinforced block placed in abutting relationship with the corresponding end of the sill, said concrete block extending laterally away from the respective end of the sill.

11. An abutment, as claimed in claim 10, wherein:

each said means for limiting lateral displacement of the bridge further include a plurality of piles having a first end contained in the concrete block, and a second end extending downwardly and away from said concrete block.

12. An abutment, as claimed in claim 10, wherein:

each said concrete block has a lower portion extending below said sill thus forming a shear key.

13. An abutment, as claimed in claim 8, further including:

a plurality of piles positioned around and spaced from a front face of the abutment to prevent scour.

14. An abutment, as claimed in claim 13, wherein:

at least one of said plurality of piles is connected to a portion of the facing wall extending below the sill by mechanically stabilized earth.

15. An abutment, as claimed in claim 8, further including:

a bearing member resting on said sill and extending laterally beyond said retaining enclosure through the side walls, and said bearing member further extending into the first and second means for limiting lateral displacement of the bridge.

16. An abutment, as claimed in claim 8, wherein:

said sill includes a slab of reinforced concrete.

17. An abutment, as claimed in claim 8, wherein:

said facing wall includes a first portion extending below the sill and having first and second ends, second portions extending laterally away from said first and second ends of said portion, facing wing extensions extending laterally away from each said second portions, and mechanically stabilized earth being emplaced behind said facing wall to support said facing wall along said first portion, said second portions, and said facing wing extensions.

18. An abutment for use in a bridge that interconnects a roadway extending along a centerline, said abutment comprising:

a facing wall extending substantially vertically from the ground and substantially perpendicular to the centerline;

a retaining enclosure formed in said facing wall, said retaining enclosure having a horizontally extending sill aligned substantially perpendicular to said centerline, said sill having opposing ends, and said retaining enclosure further including at least one wall extending perpendicularly from said sill;

a first lateral containment element connected to a first end of said sill;

a second lateral containment element connected to the other end of said sill;

said lateral containment elements each including a concrete reinforced block placed in abutting relationship with a corresponding end of the sill, said concrete block extending laterally away from the respective end of the sill; and wherein said first and second lateral containment elements are sized and designed to satisfy seismic design standards including a design that incorporates a seismic coefficient and a total mass of the bridge, the seismic coefficient and total mass of the bridge substantially determining a seismic horizontal load that can be applied to said first and second lateral containment elements during a seismic event.

19. An abutment, as claimed in claim 18, wherein:

each said concrete block has a lower portion extending below said sill thus forming a shear key.

20. An abutment for use in a bridge that interconnects a roadway extending along a centerline, said abutment comprising:

a facing wall extending substantially vertically from the ground and substantially perpendicular to a centerline;

a retaining enclosure formed in said facing wall, said retaining enclosure having a horizontally extending sill, said sill having first and second ends;

means for limiting lateral displacement of the bridge at each end of said sill, said means for limiting lateral displacement including structure that extends laterally away from the ends of the sill, said structure being designed to withstand forces caused by lateral displacement of the bridge during a seismic event, said design including one that incorporates a seismic coefficient and a total mass of the bridge, the seismic coefficient and total bridge mass substantially determining a seismic horizontal load which is experienced during the seismic event.

21. An abutment, as claimed in claim 20, further including:

a plurality of piles positioned around and spaced from a front face of the abutment to prevent scour.

* * * * *

UNITED STATES PATENT AND TRADEMARK OFFICE

CERTIFICATE OF CORRECTION

PATENT NO. : 6,745,421 B2
DATED : June 8, 2002
INVENTOR(S) : Barrett et al.

It is certified that error appears in the above-identified patent and that said Letters Patent is hereby corrected as shown below:

Column 12,
Line 9, after "event" please insert -- , -- therein.

Signed and Sealed this

Twenty-first Day of December, 2004

JON W. DUDAS
*Director of the United States Patent and Trademark Office*